US006547261B2

(12) United States Patent
Gorza et al.

(10) Patent No.: US 6,547,261 B2
(45) Date of Patent: Apr. 15, 2003

(54) ADJUSTMENT DEVICE, PARTICULARLY FOR ADJUSTING THE SIZE OF AN IN-LINE ROLLER SKATE

(75) Inventors: Roberto Gorza, Feltre (IT); Cristiano Benetti, Postioma (IT)

(73) Assignee: Benetton Group S.p.A., Ponzano Veneto (IT)

( * ) Notice: Subject to any disclaimer, the term of this patent is extended or adjusted under 35 U.S.C. 154(b) by 12 days.

(21) Appl. No.: 09/737,955

(22) Filed: Dec. 18, 2000

(65) Prior Publication Data

US 2001/0006281 A1 Jul. 5, 2001

(30) Foreign Application Priority Data

Dec. 28, 1999 (IT) ..... TV99A0144

(51) Int. Cl.[7] ..... A63C 17/06; A63C 17/26

(52) U.S. Cl. ..... 280/11.223; 280/11.26; 280/11.27

(58) Field of Search ..... 280/11.223, 11.224, 280/11.231, 11.19, 11.204, 11.26, 11.27, 11.33

(56) References Cited

U.S. PATENT DOCUMENTS 3,309,098 A * 3/1967 Parker ..... 280/11.26
3,693,988 A * 9/1972 Steinhiser ..... 280/11.23
4,684,140 A * 8/1987 Olivieri ..... 280/11.26
5,295,701 A * 3/1994 Reiber et al. ..... 280/11.22
5,484,149 A * 1/1996 Lee ..... 280/11.26
5,580,070 A * 12/1996 Bekessy ..... 280/11.27
5,620,190 A * 4/1997 Maggiore ..... 280/11.21
5,645,288 A * 7/1997 Lu ..... 280/11.26
5,678,833 A 10/1997 Olson et al. ..... 280/11.22
5,836,592 A * 11/1998 Chang ..... 280/11.26
5,931,478 A * 8/1999 Chang ..... 280/11.22
6,217,039 B1 * 4/2001 Iverson et al. ..... 280/11.26
6,247,707 B1 * 6/2001 Conte ..... 280/11.221
6,276,697 B1 * 8/2001 Lin ..... 280/11.26

FOREIGN PATENT DOCUMENTS

EP 0 955 074 11/1999

* cited by examiner

*Primary Examiner*—Brian L. Johnson
*Assistant Examiner*—Bridget Avery
(74) *Attorney, Agent, or Firm*—Guido Modiano; Albert Josif; Daniel O'Byrne

(57) ABSTRACT

An adjustment device, particularly for adjusting the size of an in-line roller skate composed of a frame connected to the wheels and to the heel unit of a shell to which a cuff is articulated. A toe unit for containing an innerboot is slidingly connected with the frame, can be positioned selectively, and can be actuated directly by the user.

11 Claims, 4 Drawing Sheets

ADJUSTMENT DEVICE, PARTICULARLY FOR ADJUSTING THE SIZE OF AN IN-LINE ROLLER SKATE

BACKGROUND OF THE INVENTION

The present invention relates to an adjustment device, particularly for adjusting the size of an in-line roller skate.

At present there is the need, especially for young users who are still growing, to have skates provided with a size adjustment device.

A device of this type is particularly interesting because it would allow use for an extended period and would also allow to swap or lend skates also between users having different foot sizes.

U.S. Pat. No. 5,678,833 discloses an in-line roller skate whose length can be adjusted. Such skate has a rigid supporting frame for a plurality of in-line wheels, a shell which comprises a toe unit and a heel unit, and appropriate first means for engagement to said frame which are formed in the heel unit.

The heel unit has, in a lower region, a sole which is suitable to be slidingly connected, by virtue of second engagement means, to the base of the toe unit. The second engagement means comprises third means, such as a screw, for detachably coupling the base of the toe unit to a part of the frame, thus allowing the toe unit to slide with respect to the heel unit in a direction which is parallel to the longitudinal axis of the skate. Such conventional skate also has a cuff which is connected to the heel unit by means of an appropriate connection device, particularly a pair of studs. The studs are connected to sliding means which are provided on the two lateral walls of the toe unit.

The main drawback of the above described conventional skate is the fact that it is complicated both structurally and as regards size adjustment.

Said adjustment in fact requires time, because it is necessary to loosen the screw by means of an appropriate tool, which one must carry during skating, and to wear the skate several times until the exact position of the heel unit with respect to the toe unit is obtained, subsequently tightening the screw again, with the possibility of unintended changes to the position of the various elements.

Another drawback of such conventional skate is the lack of any visual indication of the size or length used: this entails that a user who has already made a size adjustment earlier cannot rapidly restore the exact original position but has to perform the same complicated procedures he or she performed the first time.

EP-955,074 discloses an in-line roller skate which comprises a shell which is associated, in a lower region, with a wheel supporting frame and a heel unit which is slidingly associated with the shell. The skate has sliding means adapted to selectively move the heel unit with respect to the shell in an axial direction.

Adjustment occurs by virtue of the rotation of a toothed roller which acts on a series of flat teeth formed at the lower part of the heel unit: this rotation entails the movement of the heel unit along the longitudinal axis of the skate and thus changes its size.

The main drawback of this known type of skate is the fact that adjustment occurs by moving the rear part of the shoe: in this manner, the position of the heel is shifted, causing a disadvantageous displacement of the center of gravity with respect to the wheels.

This is a drawback, because almost all the weight of the body is transmitted to the ground by means of the resting region that corresponds to the heel, and a displacement thereof can lead to considerable adaptation difficulties in the practice of the sport.

SUMMARY OF THE INVENTION

The aim of the present invention is therefore to solve the noted problems, eliminating the drawbacks of the cited known art and thus providing a device which allows to obtain a simple and effective adjustment of the size of a skate.

An important object of the invention is to provide a device which allows to rapidly visualize the size selected by the user.

Another important object is to provide a device which can be easily accessed by the user without the need to have additional tools or instruments.

Another object is to provide an adjustment device which allows easy and immediate adaptation to the new dimensions of the shoe without destabilizing the user's balance during practice of the sport.

Another object is to provide a device which is simple and straighforward to use.

Another object is to provide an invention which is structurally simple and has low manufacturing costs.

This aim and these and other objects which will become better apparent hereinafter are achieved by an adjustment device, particularly for adjusting the size of a skate composed of a frame provided with means for connection to two or more in-line wheels and to the heel unit of a shell, a toe unit for containing an innerboot being slidingly associated with said frame, characterized in that said adjustment device comprises an actuator which is arranged outside said frame and can be actuated directly by the user in order to position said toe unit selectively with respect to said frame, said actuator having a first position, in which said toe unit can slide freely with respect to said frame, and a second position, in which said toe unit is locked with respect to said frame.

BRIEF DESCRIPTION OF THE DRAWINGS

Further characteristics and advantages of the invention will become better apparent from the detailed description of a particular embodiment, illustrated only by way of non-limitative example in the accompanying drawings, wherein.

DESCRIPTION OF THE PREFERRED EMBODIMENTS

Figure 1:
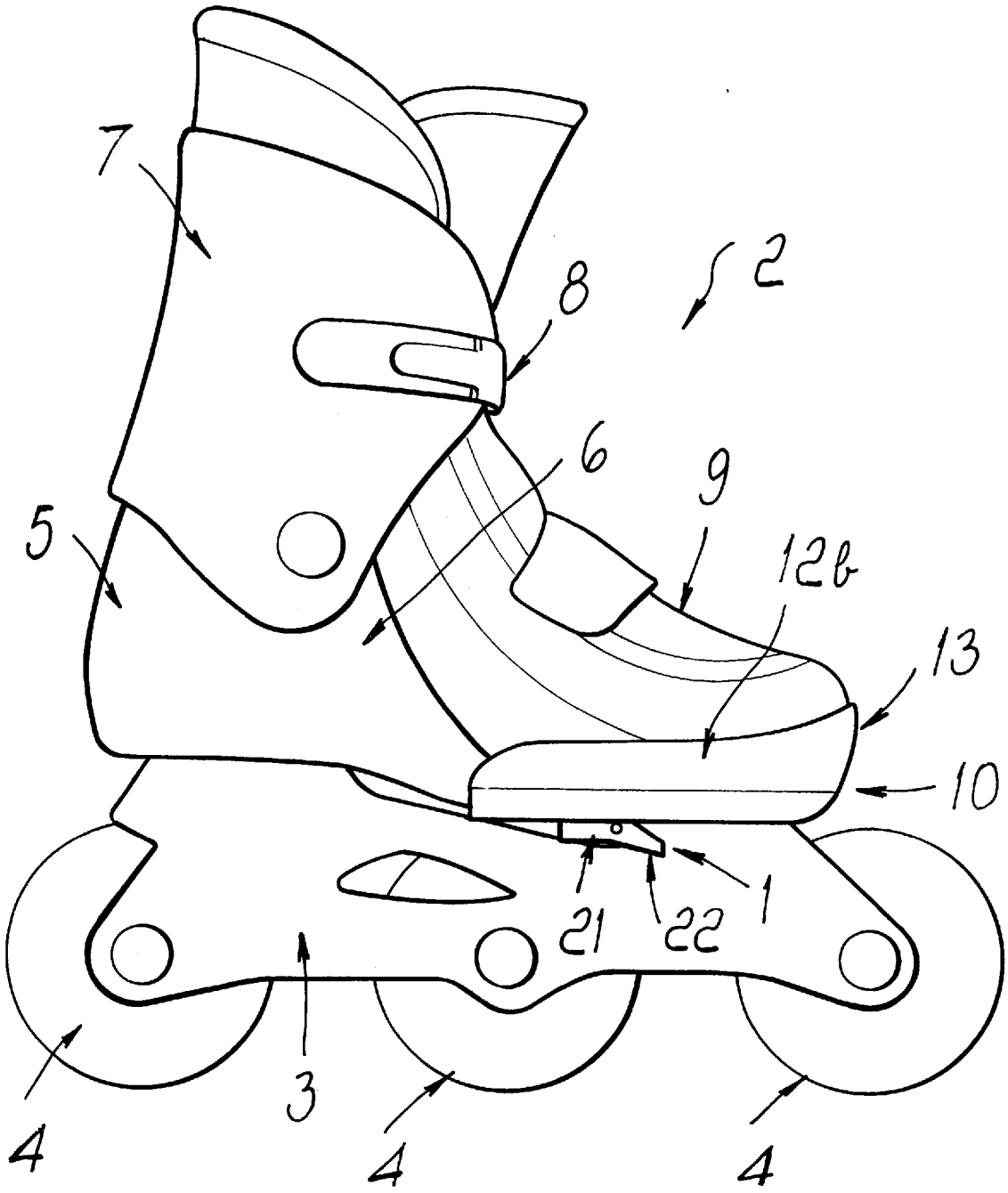
FIG. 1 is a side view of a skate provided with the adjustment device according to the invention.
Figure 2:
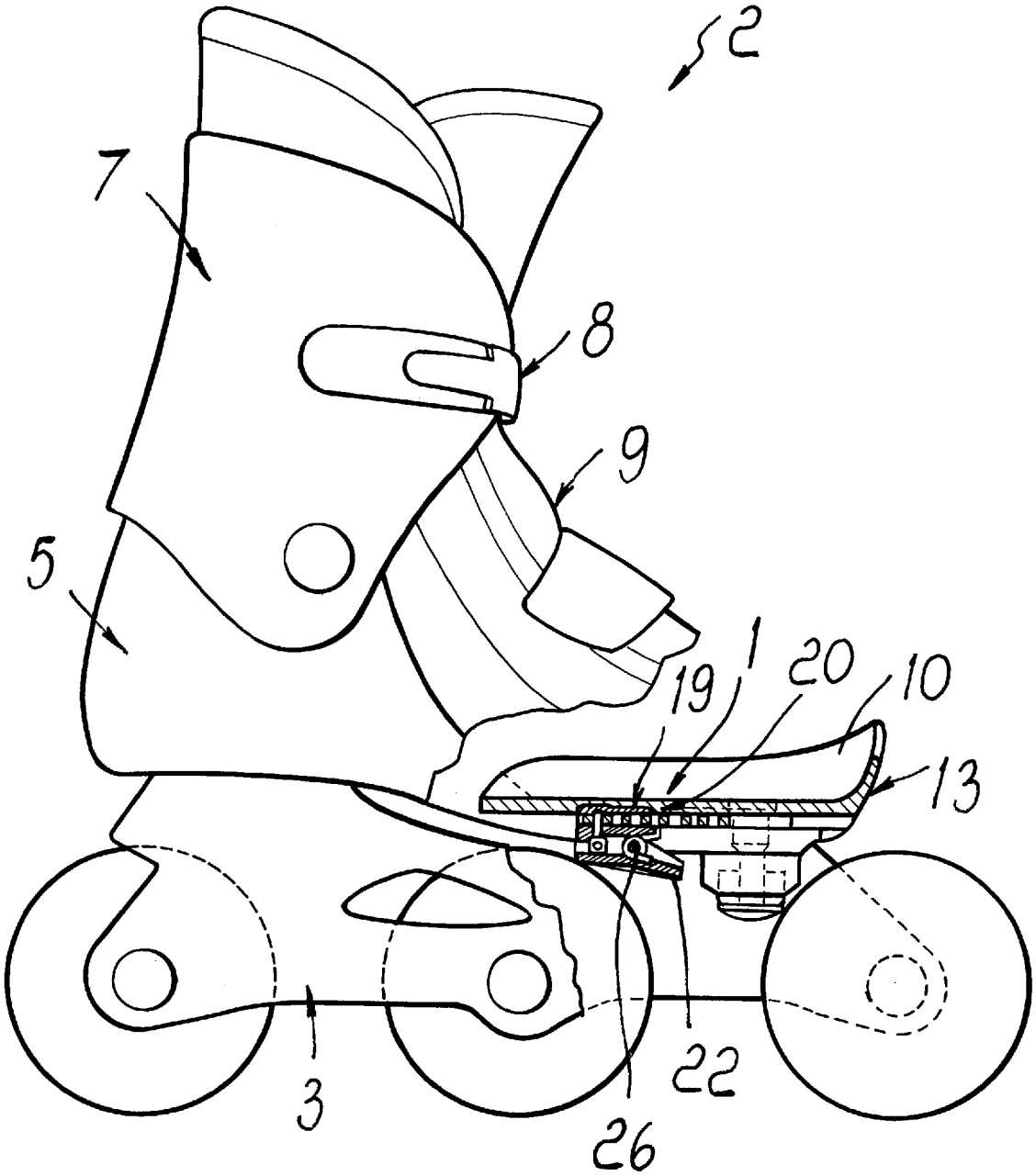
FIG. 2 is a side view, partially cut away in the toe unit region, of the skate in a first position.
Figure 3:
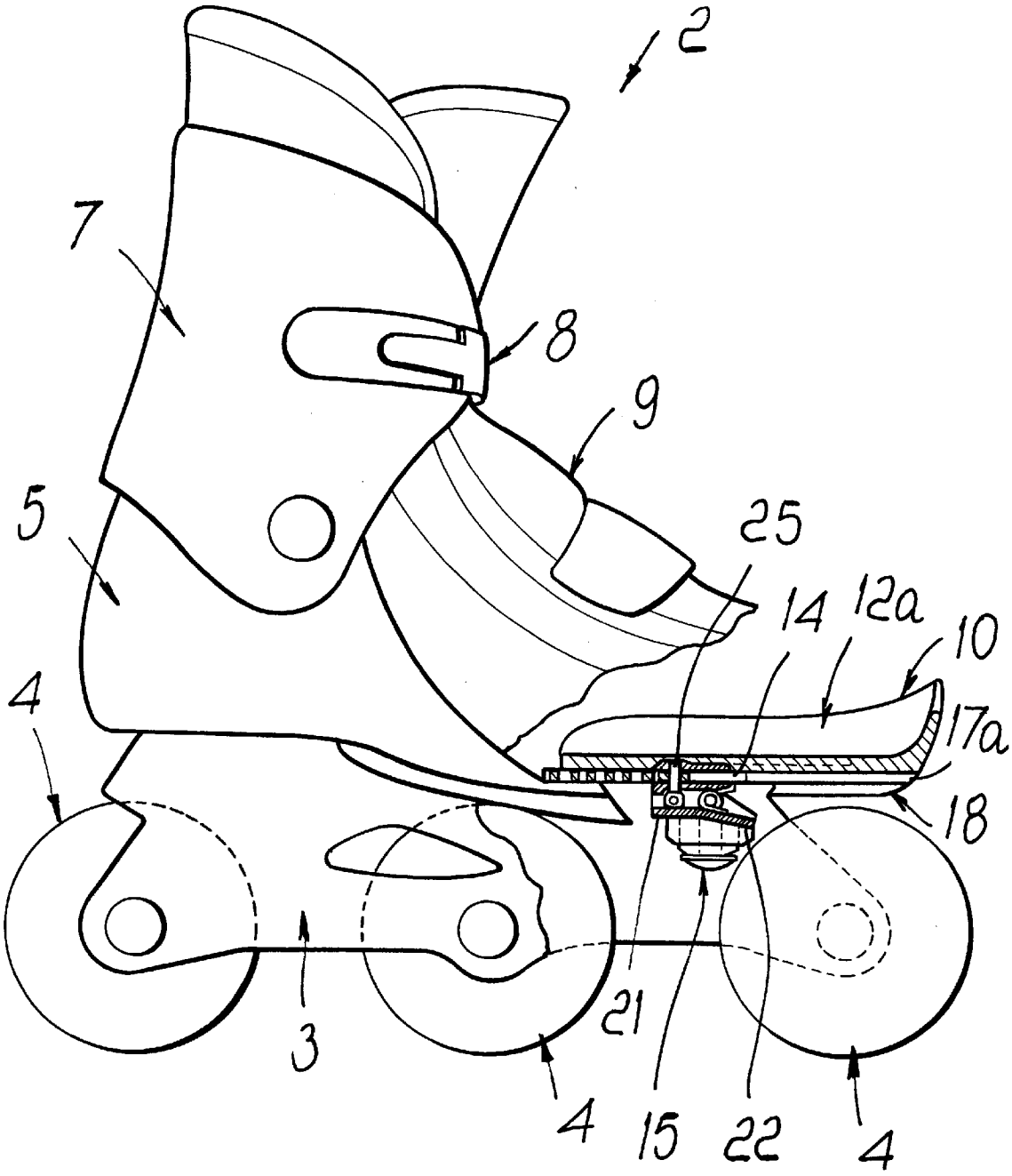
FIG. 3 is a side view, partially cut away in the toe unit region, of the skate in a second position.

With reference to the above figures, the numeral 1 designates a device for adjusting the size of a skate 2 composed of a frame 3 which has a U-shaped transverse cross-section and has appropriate means for connection to three in-line wheels, generally designated by the reference numeral 4, and to a heel unit, designated by the reference numeral 5.

A cuff 7 is optionally articulated to said heel unit 5, which is part of a shell designated by the reference numeral 6. The cuff 7 has closure means, designated by the reference numeral 8, for an innerboot 9, which is relatively soft and is provided on its tip with a per se known device for longitudinal elongation, which is obtained for example by using bands of elastic material.

A toe unit, designated by the reference numeral 10, is slidingly associated with frame 3 and is constituted by a flat supporting surface 11 which is provided with a first lateral edge 12*a* and a second lateral edge 12*b,* which are raised, and with a front edge 13, which is also raised and appropriately curved so as to blend with the first and second lateral edges in order to contain innerboot 9.

The supporting surface 11 of toe unit 10 rests, in a lower region, on an anchoring plate, designated by the reference numeral 14, which can be rigidly coupled, in a lower region, to frame 3 by means of a first fixing pivot 15 which can be associated with a complementarily threaded female thread 16 which is rigidly coupled to said anchoring plate 14.

The toe unit 10 can slide longitudinally with respect to the anchoring plate 14 by means of a first guide and a second guide, designated by the reference numerals 17*a* and 17*b,* which are horizontal and are formed on the lower surface of the toe unit 10.

First guide 17*a* is constituted, for example, by a wing 18 which protrudes below toe unit 10.

Wing 18, which is arranged below said first lateral edge 12*a,* which is arranged on the inside of said skate 2, has a transverse cross-section which is L-shaped, its free end being directed toward the opposite side of skate 2.

The second guide 17*b,* arranged on the outer side of the skate 2 in opposition to the first guide 17*a,* is also constituted by an element, designated by the reference numeral 19, which is rigidly coupled to the toe unit 10, has a C-shaped cross-section and can slide with respect to the anchoring plate 14.

Sliding element 19 is arranged in a complementarily shaped seat, designated by the reference numeral 20, which is formed on the lower surface of toe unit 10.

Wing 18 and sliding element 19 are therefore arranged with respect to each other so as to constitute two longitudinal seats which are shaped complementarily with respect to the edges of anchoring plate 14, for the sliding of toe unit 10 with respect to the anchoring plate.

The adjustment device is associated with sliding element 19 in a lower region and comprises an actuator, such as for example a button, designated by the reference numeral 21, which can be actuated directly by the user at the free end 22. The actuator or button 21 thus has a first working position, in which the toe unit can slide freely with respect to the frame, and a second working position, in which the toe unit is locked with respect to said frame.

The button 21 is constituted by an inverted C-shaped plate which is pivoted transversely, by means of a second pivot 23, to a pair of wings 50*a* and 50*b* which are mutually parallel and protrude downward from the sliding element 19.

A return spring, designated by the reference numeral 24, is arranged coaxially to second pivot 23 and is adapted to return button 21 to the second position after it has been released by the user from the first position.

A locking pin, designated by the reference numeral 25, is arranged in the opposite position with respect to free end 22 and is pivoted to a pivot 26 which is again arranged transversely to the pair of wings 50*a* and 50*b*.

Toe unit 10 can be positioned selectively with respect to anchoring plate 14 by virtue of the detachable connection between locking pin 25 and one of a plurality of complementarily shaped holes, generally designated by the reference numeral 27, which are mutually equidistant along a longitudinal axis and are formed proximate to the outer edge of anchoring plate 14.

Holes 27 are therefore aligned, so that each one corresponds to a specific position of toe unit 10 and therefore to a specific size of the skate 2.

The height of anchoring plate 14 must be such as to allow locking pin 25, when the button is actuated from the second position to the first position, to slide vertically downward by an extent which disengages it from the respective hole 27 in which it was arranged, so as to allow the sliding of toe until 10 along anchoring plate 14.

Figure 4:
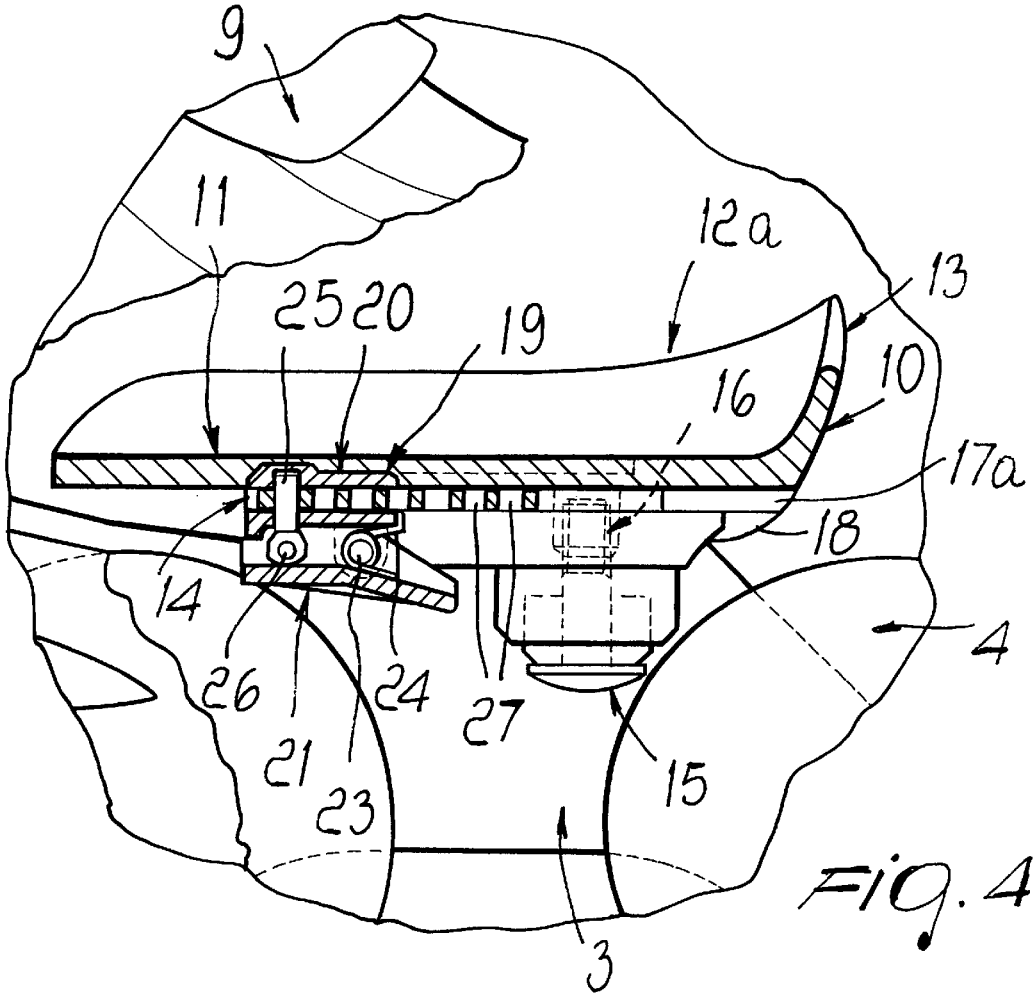
FIG. 4 is a side view of a detail of FIG. 3.
Figure 5:
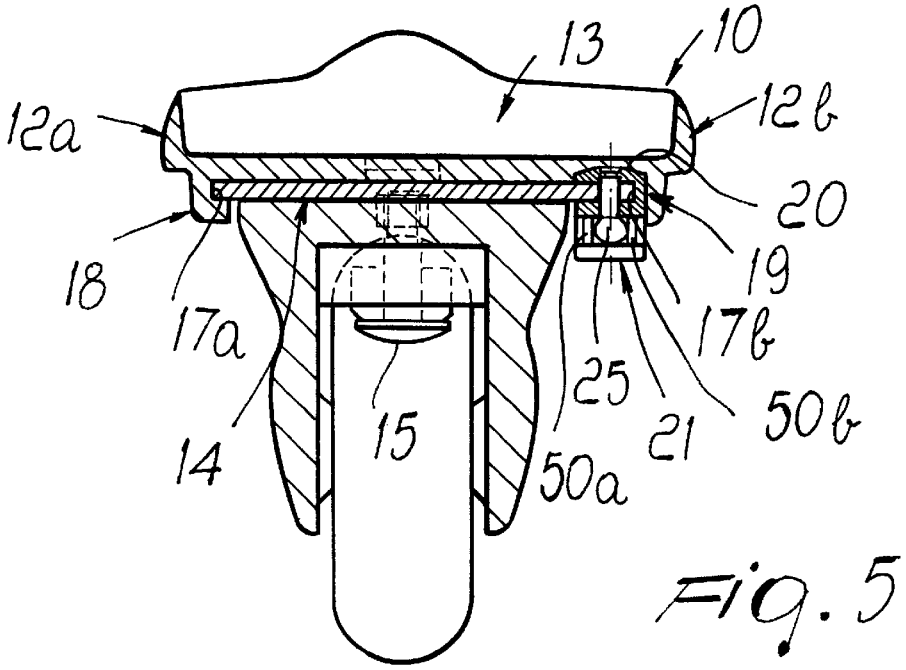
FIG. 5 is a rear view of the skate.

The operation of the device is as follows: with reference to FIG. 4, the user can vary the size of the skate 2 simply by acting on the free end 22 of button 21, moving it from the second position to the first position, so as to disengage the locking pin 25 from the hole 27 in which it was arranged.

While keeping the button 21 pressed, the toe unit 10 is made to slide along the first and second guides 17*a* and 17*b* until the toe unit is arranged in the intended position.

By releasing the button 21, which is returned to the second position by the return spring 24, the locking pin 25 is arranged in another hole 27, thus rigidly coupling the toe unit 10 to the anchoring plate 14 and therefore to the frame 3.

Adapted notches or markings, arranged on the outer surface of skate 2 proximate to the adjustment device 1, can indicate the size used by each user.

It has thus been found that the invention has achieved the intended aim and objects, an adjustment device having been provided which allows to obtain a simple and effective adjustment of the size of a skate and is provided with an appropriate indicator which allows to rapidly visualize the size selected by the user.

Said adjustment device can be easily adapted by the user without the need to have additional tools or instruments at hand.

The adjustment device according to the invention is susceptible of numerous modifications and variations, within the scope of the appended claims.

The materials used, as well as the dimensions that constitute the individual components of the invention, may of course be more pertinent according to the specific requirements.

What is claimed is:

1. An adjustment device for adjusting the size of an in-line roller skate composed of a wheel frame provided with means for connection to two or more in-line wheels and to a heel unit of a shell, a toe unit for containing an innerboot being slidingly associated with said frame, said two or more in-line wheels being connected exclusively to said frame exclusive of said toe unit, said adjustment device comprising an actuator which is arranged outside and laterally of said frame and can be actuated directly by the user in order to position said toe unit selectively with respect to said frame, said actuator having a first position, in which said toe unit can slide freely with respect to said frame, and a second position, in which said toe unit is locked with respect to said frame, said toe unit comprising a supporting surface which is flat and is provided with a first lateral edge and a second lateral edge which are raised and with a front edge which is also raised and curved so as to blend with said first and second lateral edges in order to contain said innerboot, said supporting surface of said toe unit resting, in a lower region, on an anchoring plate which can be rigidly coupled, in a lower region, to said frame by virtue of a first fixing pivot which is associable with a complementarily threaded female thread which is rigidly coupled to said anchoring plate, said toe unit being slidable longitudinally with respect to said anchoring plate by means of a first guide and a second guide which are horizontal, said first guide being constituted by a wing which protrudes below said toe unit, at said first lateral edge, arranged on the inner side of said skate, and has a L-shaped transverse cross-section in which the free end is directed toward the opposite side of said skate.

2. The device according to claim 1, wherein said second guide, arranged on the outer side of said skate, in opposition to said first guide, is constituted by an element which is rigidly coupled to said toe unit and has a C-shaped cross-section.

3. The device according to claim 2, wherein said element, rigidly coupled in a complementarily shaped seat formed below said toe unit, can slide with respect to said anchoring plate.

4. The device according to claim 3, wherein said wing and said sliding element are arranged, with respect to each other, so as to constitute two longitudinal seats which are shaped complementarily to the edges of said anchoring plate, for the mutual sliding of said toe unit with respect to said anchoring plate.

5. The device according to claim 4, wherein said adjustment device is associated, in a lower region, with said sliding element and comprises said actuator constituted by a button which is constituted by an inverted C-shaped plate which is pivoted transversely, by virtue of a second pivot, to a pair of mutually parallel wings which protrude downward from said sliding element, said button being actuatable directly by the user at a free end in order to move it from said second position to said first position.

6. The device according to claim 5, wherein coaxially to said second pivot, a return spring is provided being suitable to return said button to the second position after the user releases it from the first position.

7. The device according to claim 6, wherein a third locking pin is arranged opposite with respect to said free end and is pivoted to a pivot which is arranged transversely to said pair of wings.

8. The device according to claim 7, wherein said toe unit can be positioned selectively with respect to said anchoring plate by virtue of the detachable connection between said locking pin and one of a plurality of complementarily shaped holes which are mutually equidistant along a longitudinal axis and are formed proximate to the outer edge of said anchoring plate.

9. The device according to claim 8, wherein said holes are aligned so that each one is matched by a specific position of said toe unit and therefore by a specific size of said skate.

10. The device according to claim 9, wherein the height of said anchoring plate or the length of said second pivot or the dimensions of said button are such as to allow said locking pin, when the button is actuated, to slide vertically downwardly by such an extent as to disengage from the respective hole in which it was arranged, so as to allow said toe unit to slide along said anchoring plate.

11. An adjustment device for adjusting the size of a skate composed of a frame provided with means for connection to two or more in-line wheels and to the heel unit of a shell, a toe unit for containing an innerboot being slidingly associated with said frame, said adjustment device comprising an actuator which is arranged outside said frame and can be actuated directly by the user in order to position said toe unit selectively with respect to said frame, said actuator having a first position, in which said toe unit can slide freely with respect to said frame, and a second position, in which said toe unit is locked with respect to said frame, said toe unit being constituted by a supporting surface which is flat and is provided with a first lateral edge and a second lateral edge which are raised and with a front edge which is also raised and appropriately curved so as to blend with said first and second lateral edges in order to contain said innerboot, said supporting surface of said toe unit resting, in a lower region, on an anchoring plate which can be rigidly coupled, in a lower region, to said frame by virtue of a first fixing pivot which is associable with a complementarily threaded female thread which is rigidly coupled to said anchoring plate, said toe unit can slide longitudinally with respect to said anchoring plate by means of a first guide and a second guide which are horizontal, said first guide being constituted by a wing which protrudes below said toe unit, at said first lateral edge, arranged on the inner side of said skate, and having a L-shaped transverse cross-section in which the free end is directed toward the opposite side of said skate, said second guide, arranged on the outer side of said skate, in opposition to said first guide, being constituted by an element which is rigidly coupled to said toe unit and having a C-shaped cross-section.

* * * * *